US010685769B2

(12) United States Patent
Wu et al.

(10) Patent No.: US 10,685,769 B2
(45) Date of Patent: Jun. 16, 2020

(54) INTEGRATED INDUCTOR AND INTEGRATED INDUCTOR MAGNETIC CORE OF THE SAME

(71) Applicant: DELTA ELECTRONICS, INC., Taoyuan (TW)

(72) Inventors: Rui Wu, Taoyuan (TW); Jin-Ping Zhou, Taoyuan (TW); Yu Zhang, Taoyuan (TW); Jian-Hong Zeng, Taoyuan (TW); Min Zhou, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 919 days.

(21) Appl. No.: 15/092,629

(22) Filed: Apr. 7, 2016

(65) Prior Publication Data

US 2016/0300657 A1 Oct. 13, 2016

(30) Foreign Application Priority Data

Apr. 10, 2015 (CN) ..... 2015 1 0169368
Jul. 27, 2015 (CN) ..... 2015 1 0446385

(51) Int. Cl.
*H01F 3/10* (2006.01)
*H01F 37/00* (2006.01)

(52) U.S. Cl.
CPC ..... *H01F 3/10* (2013.01); *H01F 37/00* (2013.01); *H01F 2003/106* (2013.01)

(58) Field of Classification Search
CPC ..... H01F 3/10
See application file for complete search history.

(56) References Cited

U.S. PATENT DOCUMENTS 3,659,191 A * 4/1972 Spreadbury ..... G05F 3/06 323/248
4,547,705 A * 10/1985 Hirayama ..... H05B 41/2822 315/219
4,599,985 A * 7/1986 Betz ..... F02P 3/02 123/621

(Continued)

FOREIGN PATENT DOCUMENTS

CN 101989485 A 3/2011
EP 2299456 A1 3/2011

(Continued)

*Primary Examiner* — Elvin G Enad
*Assistant Examiner* — Malcolm Barnes
(74) *Attorney, Agent, or Firm* — CKC & Partners Co., LLC

(57) ABSTRACT

An integrated inductor apparatus integrated to be a plurality of inductors is provided. The integrated inductor apparatus includes inductor windings to form inductors and includes at least two windows each having at least one of the inductor windings disposed therein and magnetic core units, each having a closed geometrical structure to form one of the at least two windows, wherein two of the neighboring magnetic core units have a shared magnetic core part. The magnetic core units comprise at least two kinds of material having different magnetic permeability corresponding to different sections of the magnetic core units, wherein the reluctance of the shared magnetic core part is smaller than the reluctance of a non-shared magnetic core part of the magnetic core units.

14 Claims, 13 Drawing Sheets

(56) References Cited

U.S. PATENT DOCUMENTS 4,665,357 A * 5/1987 Herbert ..... H01F 19/00 323/345
5,257,000 A * 10/1993 Billings ..... H01F 17/0033 29/412
6,040,753 A * 3/2000 Ramakrishnan .... H01F 17/0033 336/200
6,661,327 B1 12/2003 Funk
2003/0231094 A1* 12/2003 Funk ..... H01F 27/22 336/212
2005/0093672 A1 5/2005 Harding
2006/0066292 A1* 3/2006 Tadatsu ..... G01R 15/183 324/117 H
2006/0145800 A1* 7/2006 Dadafshar ..... H01F 27/2847 336/82
2006/0197510 A1* 9/2006 Chandrasekaran . H02M 3/1588 323/222
2008/0265858 A1* 10/2008 Muratov ..... H02M 3/1584 323/301
2009/0257560 A1 10/2009 Khutoryansky et al.
2010/0085139 A1* 4/2010 Yan ..... H01F 1/15358 336/221
2011/0063065 A1* 3/2011 Hugues Douglas ..... H01F 3/10 336/170
2011/0279212 A1* 11/2011 Ikriannikov ..... H01F 17/0006 336/192
2012/0062207 A1* 3/2012 Ikriannikov ..... H01F 38/08 323/361
2012/0256719 A1* 10/2012 Shudarek ..... H02J 3/01 336/179
2013/0027169 A1* 1/2013 Yan ..... H01F 3/14 336/200
2013/0033351 A1* 2/2013 Kim ..... H01F 27/38 336/170
2014/0043127 A1* 2/2014 Worek ..... H01F 27/38 336/178
2014/0266534 A1* 9/2014 Shi ..... H01F 3/14 336/178
2015/0287512 A1* 10/2015 Winkler ..... H01F 27/24 336/178
2017/0047155 A1* 2/2017 Yao ..... H01F 27/24
2017/0278606 A1* 9/2017 Kondou ..... H01F 1/12

FOREIGN PATENT DOCUMENTS

TW 200304721 A 10/2003
TW 201248661 A 12/2012
TW 201442046 A 11/2014
WO 2016006198 A1 1/2016

* cited by examiner

INTEGRATED INDUCTOR AND INTEGRATED INDUCTOR MAGNETIC CORE OF THE SAME

RELATED APPLICATIONS

This application claims priority to China Application Serial Number 201510169368.5, filed Apr. 10, 2015 and China Application Serial Number 201510446385.9, filed Jul. 27, 2015, which are herein incorporated by reference.

BACKGROUND

Field of Invention

The present disclosure relates to a power technology. More particularly, the present disclosure relates to an integrated inductor apparatus and an integrated magnetic core of the same.

Description of Related Art

In recent years, miniaturization of switching mode power supply is an important trend of the development of power technology. In a switching mode power supply, magnetic components occupy a certain degree of the volume and contribute a certain degree of the loss. Therefore, the design and improvement of the magnetic components become very important.

In some application scenarios, such as an application with large current condition, a plurality of paths of circuits connected in parallel are used to decrease the occurrence of the ripples. In common designs of the magnetic components, in order to guarantee the unsaturation and low loss of the material, the volume of the magnetic components has to be increased to decrease the strength of the magnetic induction in the magnetic core. As a result, it is a tradeoff between persuading high efficiency and persuading high power density.

Accordingly, what is needed is a switching mode power supply and an integrated device of the same to address the above issues.

SUMMARY

An aspect of the present invention is to provide an integrated magnetic core, integrated with a plurality of inductor windings to form a plurality of inductors. The integrated magnetic core includes at least two windows and a plurality of magnetic core units. Each of the at least two windows has at least one of the inductor windings disposed therein. Each of the magnetic core units has a closed geometrical structure to form one of the at least two windows, wherein two of the neighboring magnetic core units have a shared magnetic core part. The magnetic core units include at least two kinds of material having different magnetic permeability corresponding to different sections of the magnetic core units, wherein the reluctance of the shared magnetic core part is smaller than the reluctance of a non-shared magnetic core part of the magnetic core units.

Yet another aspect of the present invention is to provide an integrated inductor apparatus to integrate a plurality of inductors. The integrated inductor apparatus includes a plurality of inductor windings and an integrated magnetic core integrated with the inductor windings to form the inductors. The integrated magnetic core includes at least two windows and a plurality of magnetic core units. Each of the at least two windows has at least one of the inductor windings disposed therein. Each of the magnetic core units has a closed geometrical structure to form one of the at least two windows, wherein two of the neighboring magnetic core units have a shared magnetic core part. The magnetic core units include at least two kinds of material having different magnetic permeability corresponding to different sections of the magnetic core units, wherein the reluctance of the shared magnetic core part is smaller than the reluctance of a non-shared magnetic core part of the magnetic core units.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
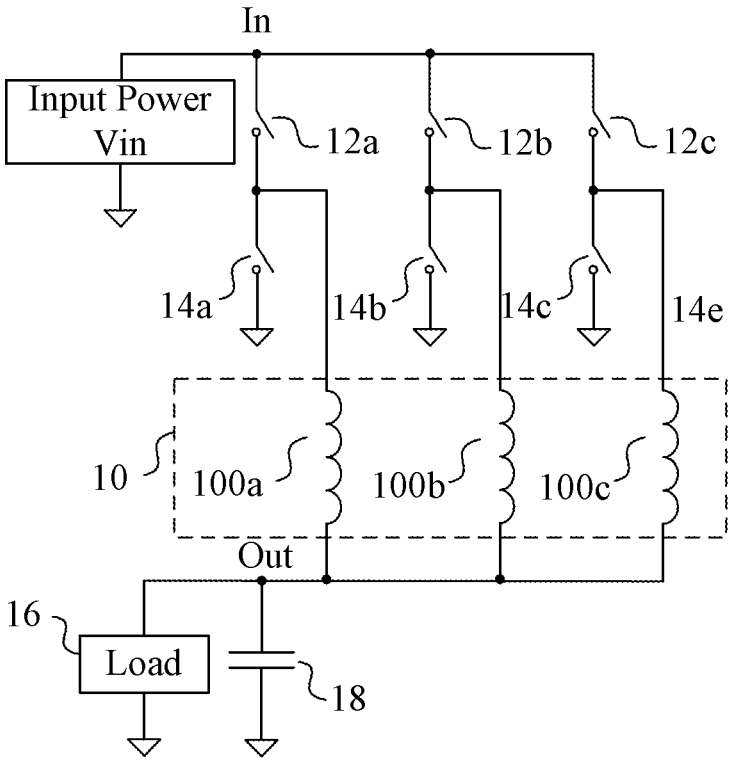
FIG. 1 is a circuit diagram of a switching mode power supply in an embodiment of the present invention.

Reference will now be made in detail to the present embodiments of the invention, examples of which are illustrated in the accompanying drawings. Wherever possible, the same reference numbers are used in the drawings and the description to refer to the same or like parts.

In embodiments, the integrated inductor apparatus may be multi-phase inductors.

Reference is now made to FIG. 1. FIG. 1 is a circuit diagram of a switching mode power supply 1 in an embodiment of the present invention. The switching mode power supply 1 includes multi-phase inductors 10, a plurality transistors 12*a*-12*c* and 14*a*-14*c* and load 16.

The multi-phase inductors 10 are electrically connected to a common output terminal OUT of the switching mode power supply 1. As a result, the multi-phase inductors 10 are the output inductors corresponding to the common output terminal OUT of the switching mode power supply 1. The multi-phase inductors 10 include a plurality of inductors 100*a*-100*c*.

The transistors 12*a*-12*c* and the corresponding transistors 14*a*-14*c* form a plurality of power conversion circuits connected in parallel. The common output terminal OUT is the output of the power conversion circuits. In the present embodiment, as illustrated in FIG. 1, each of the inductors 100*a*-100*c* is electrically connected to the corresponding transistors 12*a*-12*c* and 14*a*-14*c*. Taking the inductor 100*a* as an example, the inductor 100*a* is electrically connected to the transistors 12*a* and 14*a*. The inductors 100*a*-100*c* are further connected to a common input terminal IN. In the present embodiment, the common input terminal IN receives an input voltage Vin.

The load 16 is electrically connected to the multi-phase inductors 10 at the common output terminal OUT. In an embodiment, the switching mode power supply 1 further includes other load components, such as but not limited to the capacitor 18 illustrated in FIG. 1 to stabilize the circuit.

It is appreciated that the disposition of the multi-phase inductors 10 in the switching mode power supply 1 is merely an example. In other embodiments, the multi-phase inductors 10 can be directly electrically connected to the common input terminal IN to become input inductors and are electrically connected to the common output terminal OUT through the transistors.

Figure 2:
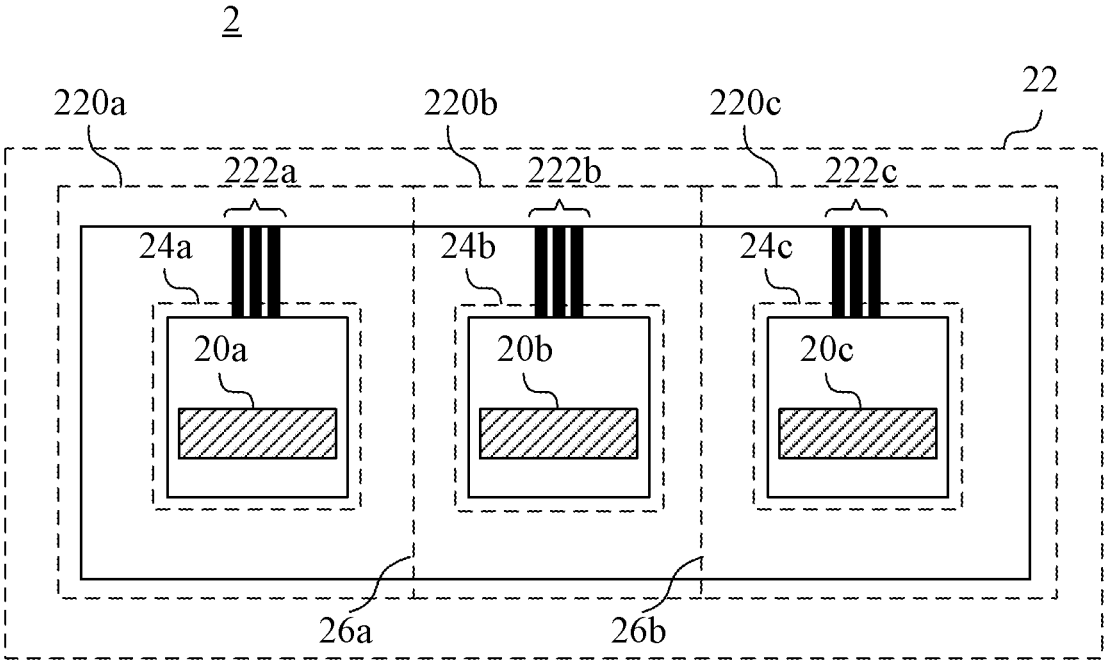
FIG. 2 is a diagram of the integrated inductor apparatus used in the multi-phase inductors in an embodiment of the present invention.

The multi-phase inductors 10 can be implemented by an integrated inductor apparatus 2 illustrated in FIG. 2. Reference now is made to FIG. 2. FIG. 2 is a diagram of the integrated inductor apparatus 2 used in the multi-phase inductors 10 in an embodiment of the present invention. The integrated inductor apparatus 2 includes a plurality of windings 20*a*-20*c* and an integrated magnetic core 22. The windings 20*a*-20*c* and the integrated magnetic core 22 form the inductors 100*a*-100*c* illustrated in FIG. 1.

The number of the windings 20*a*-20*c* is corresponding to the number of the inductors 100*a*-100*c* in the multi-phase inductors 10 illustrated in FIG. 1. In an embodiment, the windings 20*a*-20*c* includes a copper sheet, a litz wire, a PCB winding, a circular conductor or a bunched conductor. In an embodiment, the current directions of the windings 20*a*-20*c* are the same and have a predetermined phase difference, for example, 60 degrees, 120 degrees, or 180 degrees.

In the present embodiment, the integrated magnetic core 22 includes three magnetic core units 220*a*-220*c*. The magnetic core units 220*a*-220*c* include the corresponding windows 24*a*-24*c*. Each of the magnetic core units 220*a*-220*c* has a closed geometrical structure to form one of the windows 24*a*-24*c*.

As illustrated in FIG. 2, the closed geometrical structure of each of the magnetic core units 220*a*-220*c* is a quadrangle. The magnetic core unit 220*a* corresponds to the window 24*a*. The magnetic core unit 220*b* corresponds to the window 24*b*. The magnetic core unit 220*c* corresponds to the window 24*c*. The window 24*a* includes the winding 20*a*. The window 24*b* includes the winding 20*b*. The window 24*c* includes the winding 20*c*. Two of the neighboring magnetic core units have a shared magnetic core part. For example, the magnetic core units 220*a* and 220*b* have a shared magnetic core part 26*a*; the magnetic core units 220*b* and 220*c* have a shared magnetic core part 26*b*.

The magnetic core units 220*a*-220*c* includes at least two kinds of material having different permeability. In each magnetic core unit, the reluctance of shared part of magnetic core is smaller than that of the non-shared part. Taking the magnetic core units 220*a* and 220*b* as an example, the reluctance of the shared magnetic core part 26*a* is smaller than the reluctance of the non-shared magnetic core part of the magnetic core units 220*a* and 220*b*.

In an embodiment, the shared magnetic core part 26*a* is fabricated by using the material having the permeability higher than the permeability of the non-shared magnetic core part such that the reluctance of the shared magnetic core part 26*a* is smaller than the reluctance of the non-shared magnetic core part.

In another embodiment, at least part of non-shared magnetic core part in the magnetic core units 220*a*-220*c*, i.e., sections 222*a*-222*c*, includes a kind of material with lowest permeability among all kinds of material in the magnetic core units 220*a*-220*c*, to ensure the reluctance of the non-shared magnetic core part is larger than that of the shared part. For convenience, the kind of material with lowest permeability in non-shared part of magnetic core is called a first material in the application, and thus sections 222*a*-222*c* are first material sections. In an embodiment, the permeability of the first material of sections 222*a*-222*c* may be lower than or equal to 50. In an embodiment, sections 222*a*-222*c* are air gaps and the first material is air.

Figure 3A:
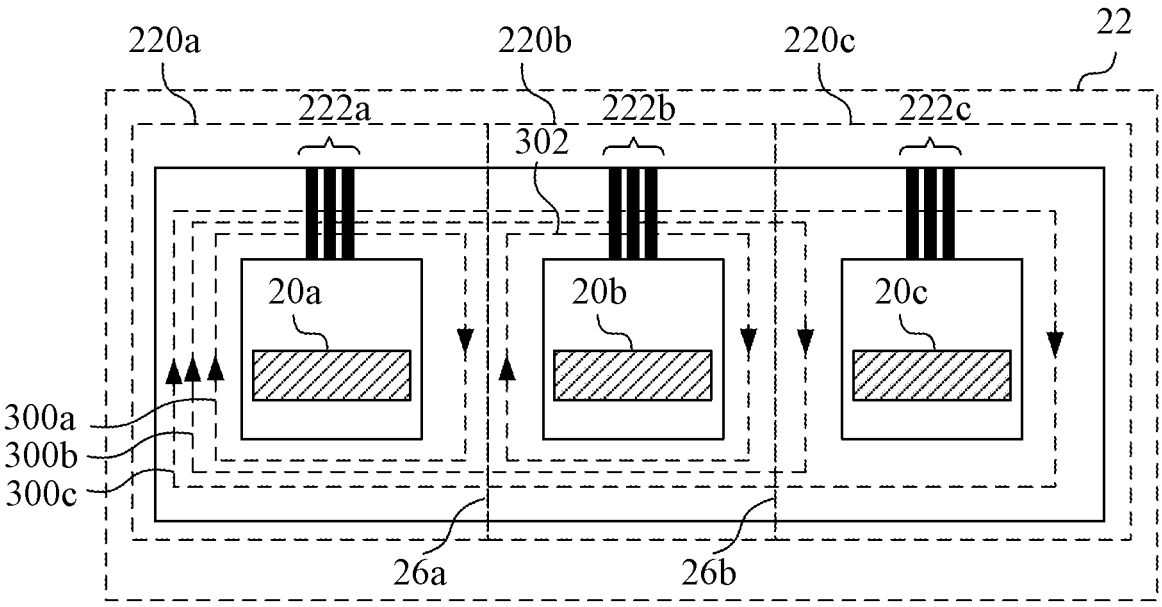
FIG. 3A is a diagram of the integrated inductor apparatus and a part of the magnetic flux therein in an embodiment of the present invention.
Figure 3B:
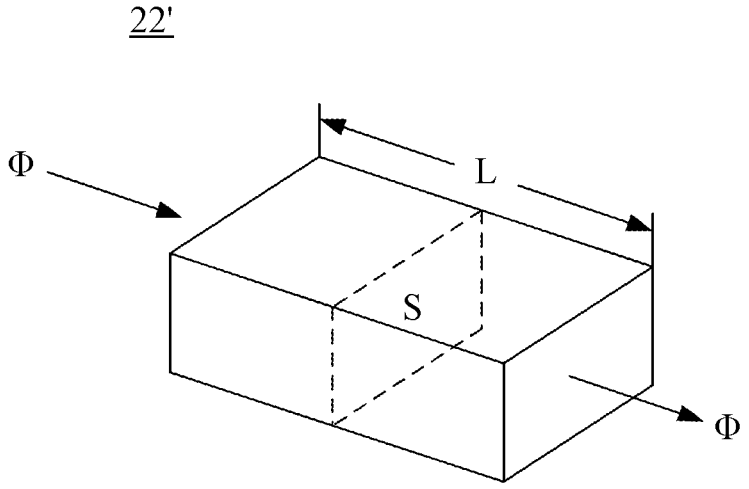
FIG. 3B is a three-dimensional diagram of partial magnetic core of the integrated magnetic core in an embodiment of the present invention.

Reference is now made to FIG. 3A-3B at the same time. FIG. 3A is a diagram of the integrated inductor apparatus 2 and magnetic flux therein in an embodiment of the present invention. FIG. 3B is a three-dimensional diagram of partial magnetic core 22' of the integrated magnetic core 22 in an embodiment of the present invention.

As illustrated in FIG. 3A, the windings 20*a* generates three magnetic fluxes 300*a*-300*c* in the integrated magnetic core 22. The magnetic flux 300*a* surrounds the magnetic core unit 220*a*, the magnetic flux 300*b* surrounds the magnetic core units 220*a* and 220*b* and the magnetic flux 300*c* surrounds the magnetic core units 220*a*-220*c*.

The magnitude of each of the magnetic flux is calculated according to the reluctance. Taking a section of the integrated magnetic core 22' illustrated in FIG. 3B having a cross-sectional area S and a length L as an example, the direction of the magnetic flux Φ is the direction indicated by an arrow in the figure, the reluctance Rm is expressed as Rm=L/(u*S). In this equation, u=ur*u0, in which u0 is the vacuum permeability, ur is the relative permeability of the material used by the section of the integrated magnetic core 22'.

As a result, the magnetic flux 300*a* in FIG. 3A passes through one first material section 222*a*. The magnetic flux 300*b* passes through two first material sections 222*a* and 222*b*. The magnetic flux 300*c* passes through three first material sections 222*a*, 222*b* and 222*c*. As the reluctance of shared part magnetic core is smaller than that of the non-shared part, flux 300*a* is much larger than the flux 300*b* and 300*c* and becomes the main flux that generated by winding 20*a*, which means only a little part of flux generated by winding 20*a* is coupled to winding 20*b* and 20*c*.

Similarly, the winding 20*b* also generates three magnetic flux in the integrated magnetic core 22, wherein only the main magnetic flux 302 corresponding to the magnetic core unit 220*b* is exemplarily illustrated in FIG. 3A.

The two of the neighboring magnetic core units 220*a* and 220*b* generate direct current magnetic fluxes with opposite directions at the shared magnetic core part 26*a*, such as the magnetic flux 300*a* and 302 illustrated in FIG. 3A.

Such a design would cancel the direct current magnetic flux in the shared part of magnetic core 22 such that the core loss of the integrated inductor apparatus decreases. Further, due to magnetic core part 26*a* shared by the neighboring magnetic core units 220*a* and 220*b*, the whole size of the integrated magnetic core 22 can be shrunk. Relatively, in order to prevent the inductor from saturation, the material of the non-shared magnetic core part has a high reluctance relative to the shared magnetic core part 26*a*. Meantime, the low reluctance of the shared part magnetic core ensures the non-coupled integration of multiphase inductor.

Figure 4:
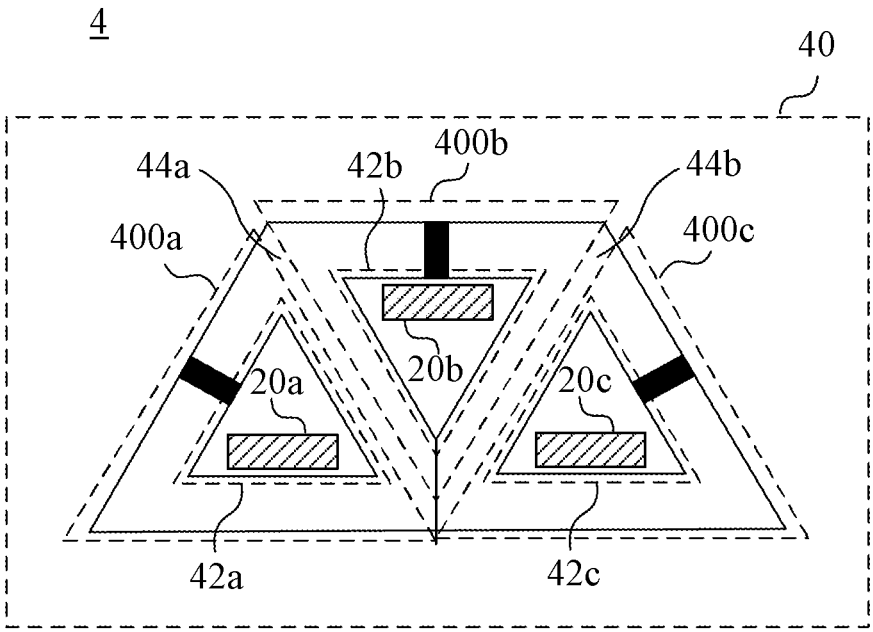
FIG. 4 is a diagram of the integrated inductor apparatus used in the multi-phase inductors in an embodiment of the present invention.

Reference is now made to FIG. 4. FIG. 4 is a diagram of the integrated inductor apparatus 4 in an embodiment of the present invention. The integrated inductor apparatus 4 includes a plurality of windings 20*a*-20*c* and an integrated magnetic core 40.

In the present embodiment, the integrated magnetic core 40 includes three magnetic core units 400*a*-400*c*. The magnetic core units 400*a*-400*c* include the corresponding windows 42*a*-42*c*. The windings 20*a*-20*c* are disposed in the windows 42*a*-42*c* respectively. The closed geometrical structure of each of the magnetic core units 400*a*-400*c* is a triangle. The magnetic core units 400*a* and 400*b* have a shared magnetic core part 44*a*. The magnetic core units 400*b* and 400*c* have a shared magnetic core part 44*b*. As described in the previous embodiments, the shared magnetic core parts 44*a* and 44*b* can be fabricated by the material having a higher initial permeability as compared to the non-shared magnetic core part to have a lower reluctance. Of course in the present embodiment, two columns of the magnetic core unit 400*b* are the shared magnetic core parts 44*a* and 44*b* respectively.

Figure 5:
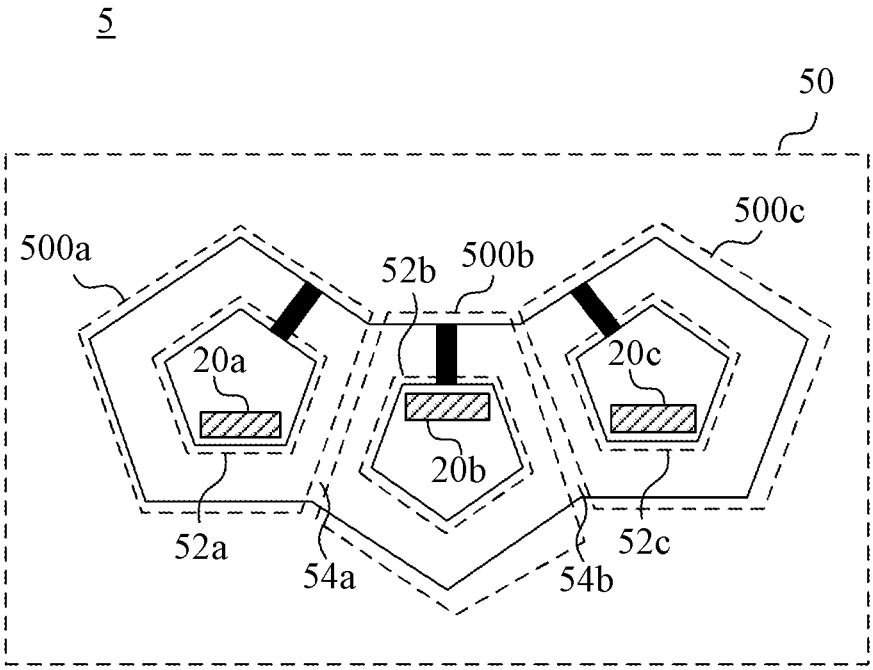
FIG. 5 is a diagram of the integrated inductor apparatus used in the multi-phase inductors in an embodiment of the present invention.

Reference is now made to FIG. 5. FIG. 5 is a diagram of the integrated inductor apparatus 5 in an embodiment of the present invention. The integrated inductor apparatus 5 includes a plurality of windings 20*a*-20*c* and an integrated magnetic core 50.

In the present embodiment, the integrated magnetic core 50 includes three magnetic core units 500*a*-500*c*. The magnetic core units 500*a*-500*c* include the corresponding windows 52*a*-52*c*. The windings 20*a*-20*c* are disposed in the windows 52*a*-52*c* respectively. The closed geometrical structure of each of the magnetic core units 400*a*-400*c* is a pentagon. The magnetic core units 500*a* and 500*b* have a shared magnetic core part 54*a*. The magnetic core units 500*b* and 500*c* have a shared magnetic core part 54*b*. As described in the previous embodiments, the shared magnetic core parts 54*a* and 54*b* can be fabricated by the material having a higher initial permeability as compared to the non-shared magnetic core part to have a lower reluctance.

In other embodiments, the number and the shape of the closed geometrical structure of the magnetic core units of the integrated magnetic core can be adjusted according to practical applications and are not limited to the number and the shape described in the above embodiments.

Reference is now made to FIG. 6A-FIG. 6G. FIG. 6A-FIG. 6G are diagrams of a single magnetic core unit 6 respectively in an embodiment of the present invention.

In the present embodiment, the closed geometrical structure of the magnetic core unit 6 is a quadrangle that includes four edges 60*a*, 60*b*, 60*c* and 60*d*. In an embodiment, the edge 60*c* is shared by other magnetic core units (not illustrated). As a result, on the non-shared magnetic core parts such as the edges 60*a*, 60*b* and 60*d*, the first material sections can be disposed. The disposition method of the first material sections, such as the number and the position of the first material sections, can be adjusted based on different requirements.

Figure 6A:
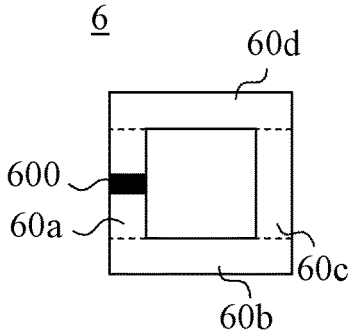
FIG. 6A-FIG. 6G are diagrams of a single magnetic core unit respectively in an embodiment of the present invention.
Figure 6B:
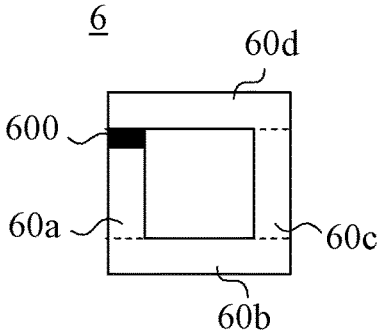
Figure 6C:
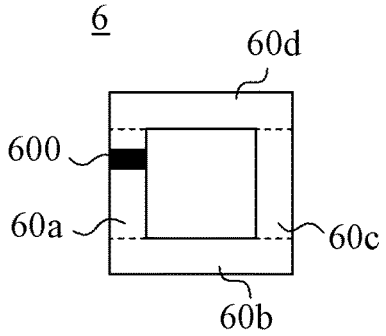

Taking FIG. 6A as an example, the first material section 600 is an air gap disposed at the center of the edge 60*a*. In FIG. 6B, the first material section 600 is disposed at one terminal of the edge 60*a*. In FIG. 6C, the first material section 600 including a single air gap is disposed at a quarter of length of the edge 60*a* relative to one terminal of the edge 60*a*.

Figure 6D:
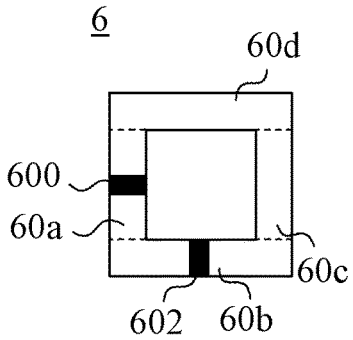
Figure 6E:
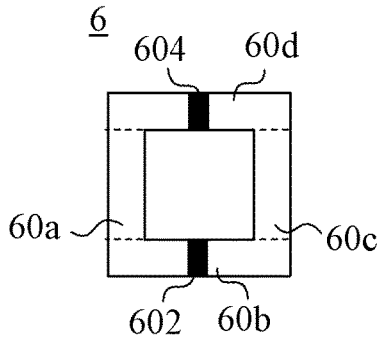
Figure 6F:
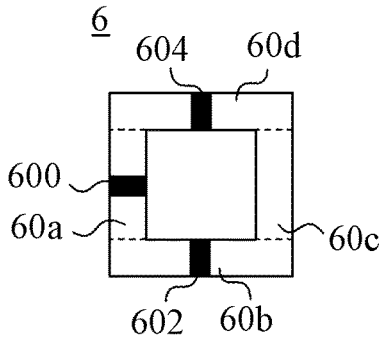

In FIG. 6D, the first material sections 600 and 602 each including a single air gap are disposed at the centers of the edges 60*a* and 60*b* respectively. In FIG. 6E, the first material sections 602 and 604 each including a single air gap are disposed at the centers of the edges 60*b* and 60*d* respectively. In FIG. 6F, the first material sections 600, 602 and 604 each including a single air gap are disposed at the centers of the edges 60*a*, 60*b* and 60*d* respectively.

The first material sections mentioned in the above embodiments are examples of discretely disposing the first material sections on the magnetic core units.

Figure 6G:
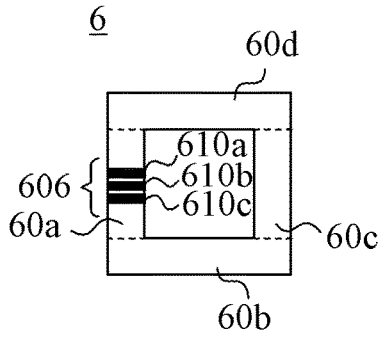

In FIG. 6G, the first material section 606 including three air gaps 610*a*, 610*b* and 610*c* are disposed at the center of the edge 60*a*. In the present embodiment, the first material section is the example of intensively disposing the first material sections on the magnetic core units.

It is appreciated that various combinations of the positions and the numbers of the first material sections and the numbers of the air gap included in the first material sections mentioned above can be used according to different conditions and are not limited thereto. Surely, the air gap in the first material sections can also be stuffed by other material having a low permeability.

Figure 7A:
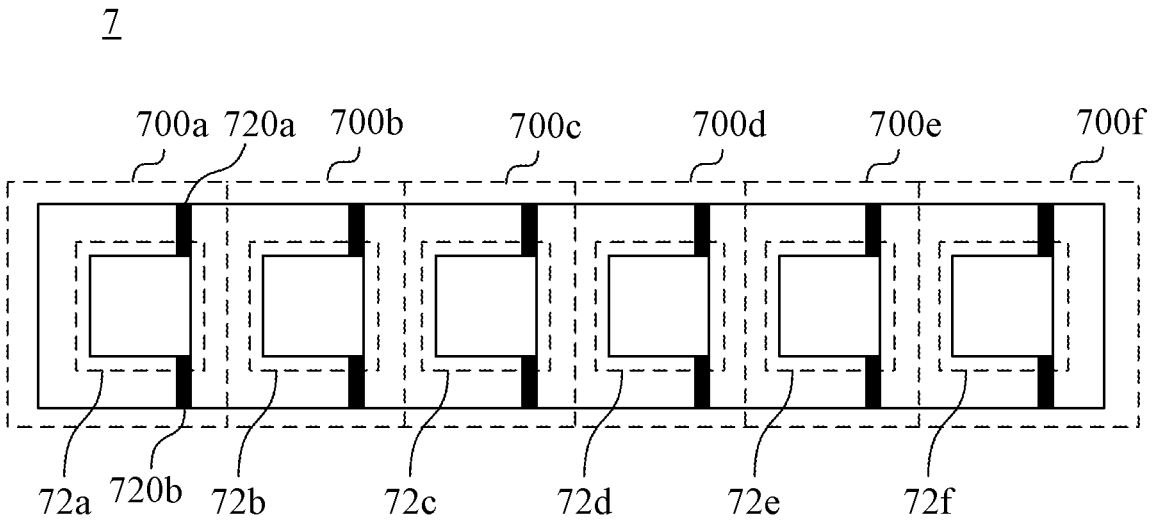
FIG. 7A and FIG. 7B are diagrams of the integrated magnetic core in an embodiment of the present invention.
Figure 7B:
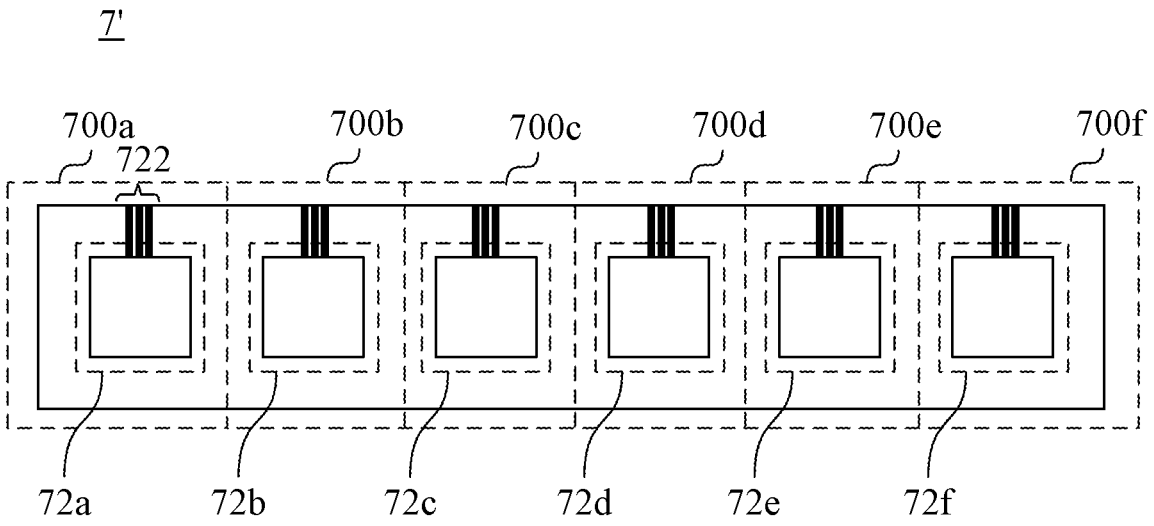

FIG. 7A and FIG. 7B are diagrams of the integrated magnetic core 7 in an embodiment of the present invention.

In the present embodiment, the integrated magnetic core 7 includes six magnetic core units 700*a*-700*f* and corresponding windows 72*a*-72*f*. The closed geometrical structure of each of the magnetic core units 700*a*-700*f* is a quadrangle. In the present embodiment, the axes of the windows of the illustrated integrated magnetic core 7 are parallel to each other.

Each of the magnetic core units 700*a*-700*f* includes at least one first high magnetic resistance material section. In FIG. 7, each of the magnetic core units 700*a*-700*f* includes two first high magnetic resistance material sections each having a single air gap and each disposed at a terminal of a corresponding edge, such as the first high magnetic resistance material section 720*a* and 720*b* corresponding to the magnetic core unit 700*a*. In FIG. 7B, each of the magnetic core units 700*a*-700*f* includes a plurality first high magnetic resistance material sections intensively disposed at the center of the corresponding edge, such as the first high magnetic resistance material section 722 corresponding to the magnetic core unit 700*a*.

Figure 8:
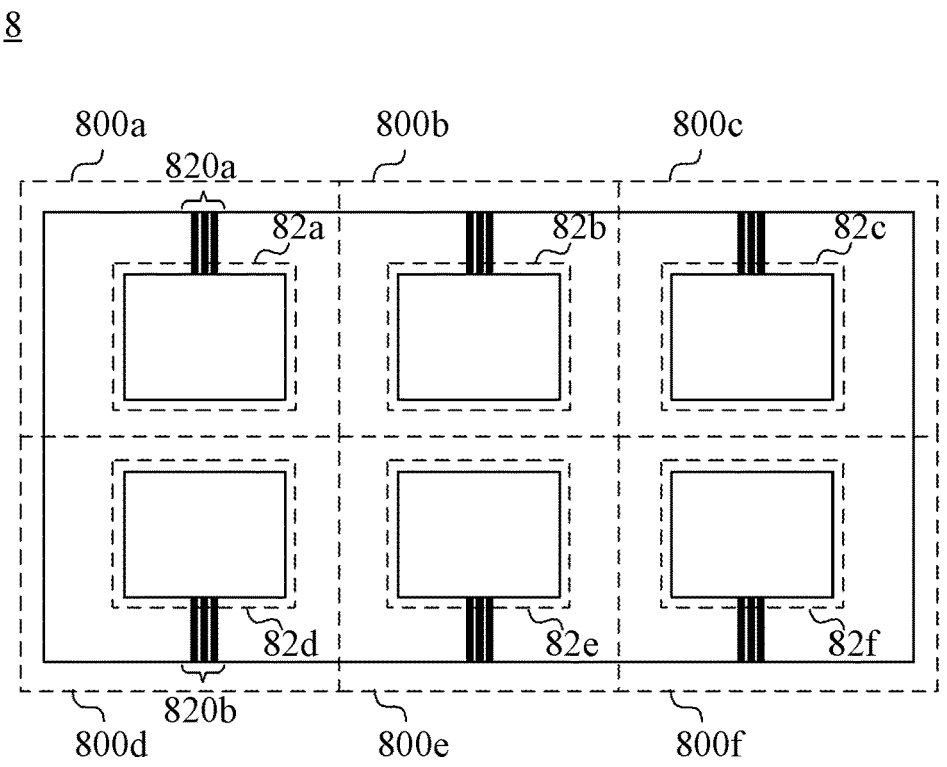
FIG. 8 is a diagram of the integrated magnetic core in an embodiment of the present invention.

FIG. 8 is a diagram of the integrated magnetic core 8 in an embodiment of the present invention.

In the present embodiment, the integrated magnetic core 8 includes six magnetic core units 800*a*-800*f* and corresponding windows 82*a*-82*f*. The closed geometrical structure of each of the magnetic core units 800*a*-800*f* is a quadrangle. In the present embodiment, each of the magnetic core units 800*a*-800*f* has two or more than two neighboring magnetic core units connected thereto. Taking the magnetic core unit 800*a* as an example, the magnetic core unit 800*a* has two neighboring magnetic core units 800*b* and 800*d* connected thereto. The magnetic core unit 800*b* has three neighboring magnetic core units 800*a*, 800*c* and 800*e* connected thereto.

Each of the magnetic core units 800*a*-800*c* includes a plurality of first material sections disposed intensively at the center of the same side of the edges, such as the first material section 820*a* corresponding to the magnetic core unit 800*a*. Each of the magnetic core units 800*d*-800*f* includes a plurality of first material sections disposed intensively at the center of the same side of the edges, such as the first material section 820*b* corresponding to the magnetic core unit 800*d*.

As a result, the magnetic core units 800*a*-800*f* included in the integrated magnetic core 8 have more shared parts to shrink the size of the integrated magnetic core 8 more efficiently.

Figure 9:
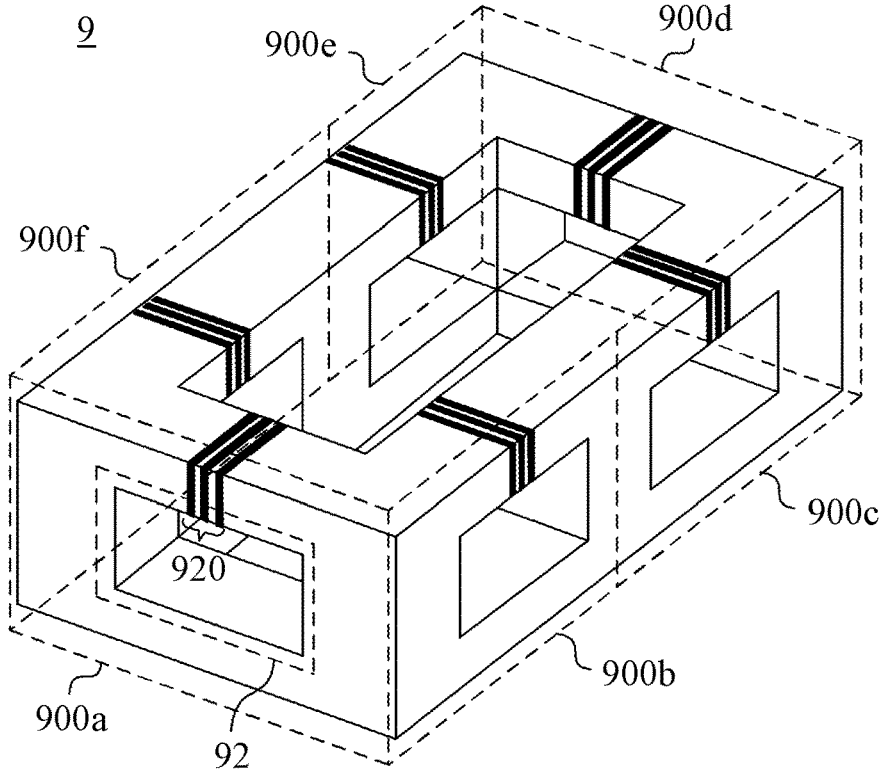
FIG. 9 is a diagram of the integrated magnetic core in an embodiment of the present invention.

FIG. 9 is a diagram of the integrated magnetic core 9 in an embodiment of the present invention.

In the present embodiment, the integrated magnetic core 9 includes six magnetic core units 900*a*-900*f* and corresponding windows, such as the window 92 corresponding to the magnetic core unit 900*a*. The closed geometrical structure of each of the magnetic core units 900*a*-900*f* is a quadrangle. In the present embodiment, each of the magnetic core units 900*a*-900*f* has two neighboring magnetic core units connected thereto to form a cubic. Taking the magnetic core unit 900*a* as an example, the magnetic core unit 900*a* has two neighboring magnetic core units 900*b* and 900*f* connected thereto. The magnetic core unit 900*c* has two neighboring magnetic core units 900*b* and 900*d* connected thereto.

Each of the magnetic core units 900*a*-900*f* includes a plurality of first material sections disposed at the center of the same side of the edges, such as the first material section 920 corresponding to the magnetic core unit 900*a*.

As a result, the magnetic core units 900*a*-900*f* included in the integrated magnetic core 9 together form a cubic to shrink the size of the integrated magnetic core 9 more efficiently.

Figure 10:
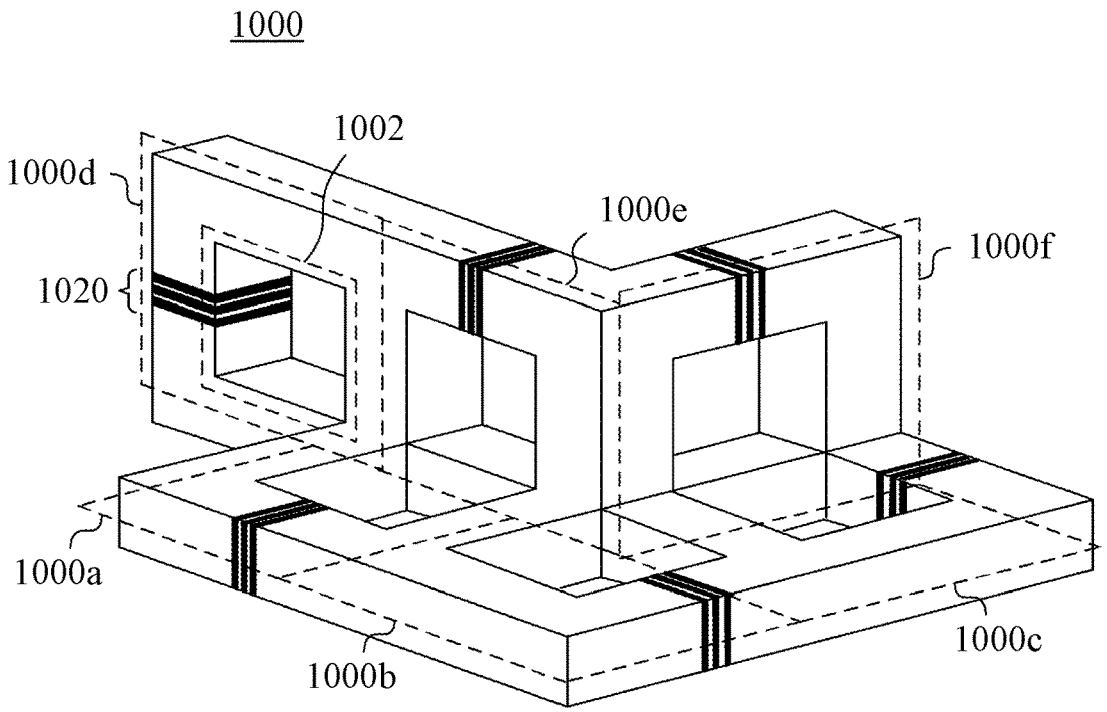
FIG. 10 is a diagram of the integrated magnetic core in an embodiment of the present invention.

FIG. 10 is a diagram of the integrated magnetic core 1000 in an embodiment of the present invention.

In the present embodiment, the integrated magnetic core 1000 includes six magnetic core units 1000*a*-1000*f* and corresponding windows, such as the window 1002 corresponding to the magnetic core unit 1000*d*. The closed geometrical structure of each of the magnetic core units 1000*a*-1000*f* is a quadrangle. In the present embodiment, the magnetic core units 1000*a*-1000*c* are on the same plane, and the magnetic core unit 1000*b* has the neighboring magnetic core units 1000*a* and 1000*c* connected thereto. The magnetic core units 1000*d*-1000*f* are all on another plane, and the magnetic core unit 1000*e* has the neighboring magnetic core units 1000*b* and 1000*f* connected thereto. The magnetic core units 1000*e* and 1000*f* are respectively connected to the magnetic core units 1000*a* and 1000*c*.

The magnetic core units 1000*a*-1000*c* and the magnetic core units 1000*d*-1000*f* are vertical to each other. As a result, the axes of the windows that the magnetic core units 1000*a*-1000*c* and the magnetic core units 1000*d*-1000*f* corresponding to are vertical to each other to form an irregular three-dimensional shape.

In the present embodiment, each of the magnetic core units 1000*a*-1000*f* includes a plurality of first material sections disposed at the center of each one of the edges, such as the first material section 1020 corresponding to the magnetic core unit 1000*d* illustrated in FIG. 10.

As a result, the magnetic core units 1000*a*-1000*f* included in the integrated magnetic core 1000 can form an irregular three-dimensional shape according to the practical requirements.

Figure 11:
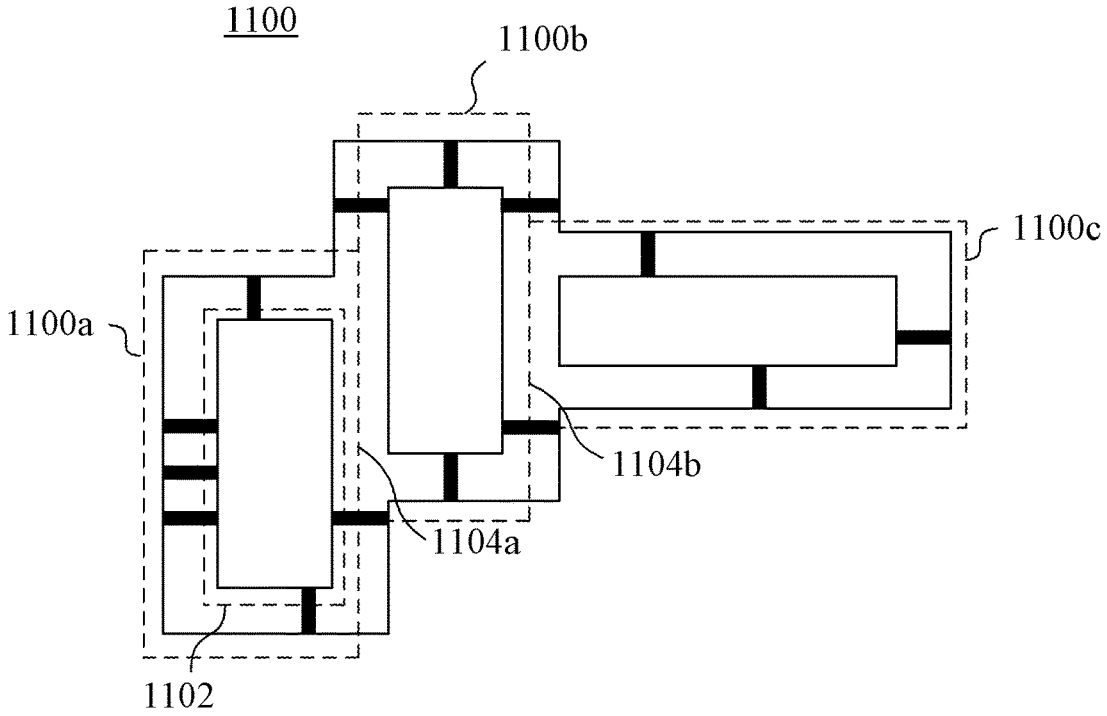
FIG. 11 is a diagram of the integrated magnetic core in an embodiment of the present invention.

FIG. 11 is a diagram of the integrated magnetic core 1100 in an embodiment of the present invention.

In the present embodiment, the integrated magnetic core 1100 includes three magnetic core units 1100*a*-1100*c* and corresponding windows, such as the window 1102 corresponding to the magnetic core unit 1100*a*. The closed geometrical structure of each of the magnetic core units 1100*a*-1100*c* is a rectangle. In the present embodiment, a magnetic core part 1104*a* is partially shared by the edges of the magnetic core units 1100*a* and 1100*b*. A magnetic core part 1104*b* is partially shared by the edges of the magnetic core units 1100*b* and 1100*c*.

Further, various combination of the numbers and the positions of the first material sections included in the magnetic core units 1100*a*-1100*c* can be used. It is appreciated that though some of the edges of the magnetic core units 1100*a*-1100*c* include the shared magnetic core parts 1104*a* and 1104*b*, the first material sections can still be formed on the non-shared part of these edges.

As a result, the edges of the magnetic core units 1100*a*-1100*c* included in the integrated magnetic core 1100 can be formed with a partially shared manner according to the practical requirements.

Figure 12:
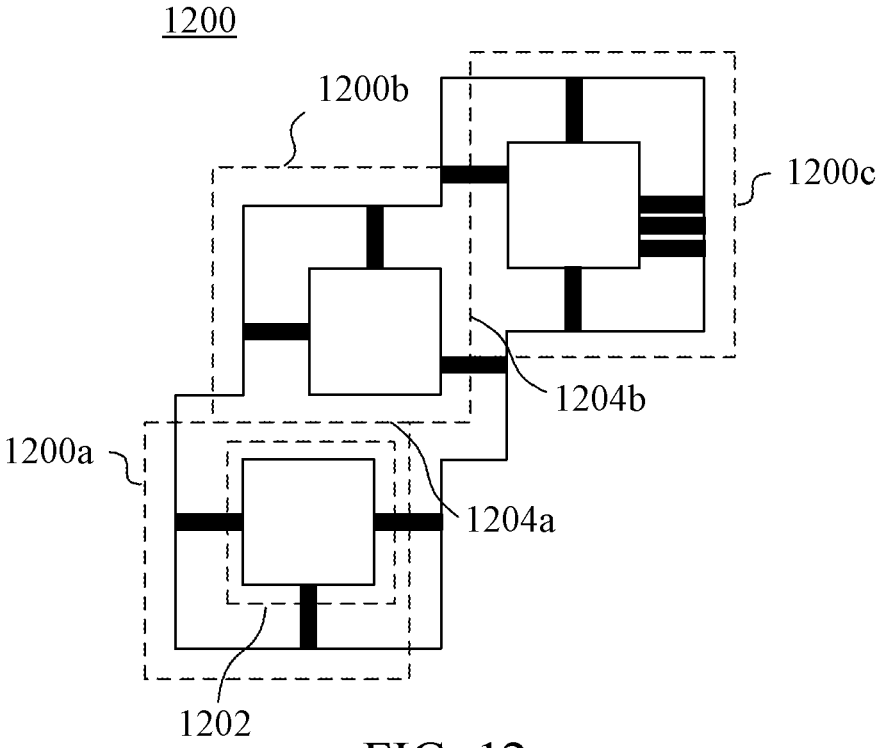
FIG. 12 is a diagram of the integrated magnetic core in an embodiment of the present invention.

FIG. 12 is a diagram of the integrated magnetic core 1200 in an embodiment of the present invention.

In the present embodiment, the integrated magnetic core 1200 includes three magnetic core units 1200*a*-1200*c* and corresponding windows, such as the window 1202 corresponding to the magnetic core unit 1200*a*. The closed geometrical structure of each of the magnetic core units 1200*a*-1200*c* is a rectangle. In the present embodiment, a magnetic core part 1204*a* is partially shared by the edges of the magnetic core units 1200*a* and 1200*b*. A magnetic core part 1204*b* is partially shared by the edges of the magnetic core units 1200*b* and 1200*c*.

Further, various combination of the numbers and the positions of the first material sections included in the magnetic core units 1200*a*-1200*c* can be used. It is appreciated that though some of the edges of the magnetic core units 1200*a*-1200*c* includes the shared magnetic core parts 1204*a* and 1204*b*, the first material sections can still be formed on the non-shared part of these edges.

As a result, the edges of the magnetic core units 1200*a*-1200*c* included in the integrated magnetic core 1200 can be formed with a partially shared manner according to the practical requirements.

Figure 13:
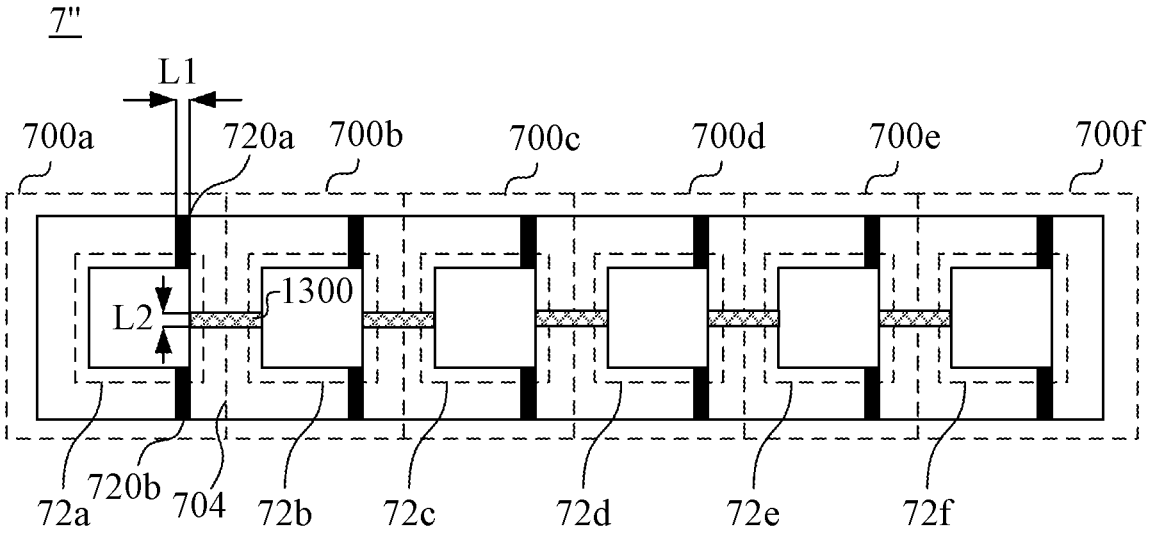
FIG. 13 is a diagram of the integrated magnetic core in an embodiment of the present invention.

FIG. 13 is a diagram of the integrated magnetic core 7" in an embodiment of the present invention.

In the present embodiment, the integrated magnetic core 7" is similar to the integrated magnetic core 7 illustrated in FIG. 7 and includes six magnetic core units 700*a*-700*f* and corresponding windows 72*a*-72*f*. The closed geometrical structure of each of the magnetic core units 700*a*-700*f* is a quadrangle. Each of the magnetic core units 700*a*-700*f* includes two first high magnetic resistance material sections each having a single air gap and each being disposed at one terminal of the corresponding edge, such as the first high magnetic resistance material sections 720*a* and 720*b* corresponding to the magnetic core unit 700*a*.

However, in the present embodiment, taking the shared magnetic core part 704 of the magnetic core units 700*a* and 700*b* as an example, the shared magnetic core part 704 includes a section with a second low permeability material. Such a section with low permeability material in shared part is named second material section. As a result, in an embodiment, when the permeability of the first material of the non-shared magnetic core unit 700*a* section 720*a* is U1, the permeability of the other parts of the non-shared magnetic core unit 700*a* is U3, the permeability of the second material section 1300 of the shared part is U2, the permeability of the other part of the shared part is U4, U4 is larger than U2, and U3 is larger than U1. If the cross-sectional area and the length of the non-shared part of the magnetic core unit 700*a* are S1 and L1, and the cross-sectional area and the length of the shared magnetic core part 704 are S2 and L2, the reluctance Rm1 of the non-shared part would be (2*L1)/(U1*S1) under the condition that U3 is far larger than U1. The reluctance Rm2 of the shared magnetic core part 704 would be L2/(U2*S2) under the condition that U4 is far larger than U2. After the adjustment of the lengths L1 and L2 and the cross-sectional areas S1 and S2, the reluctance Rm2 of the shared magnetic core part 704 can be smaller than the reluctance Rm1 of the non-shared part.

Figure 14A:
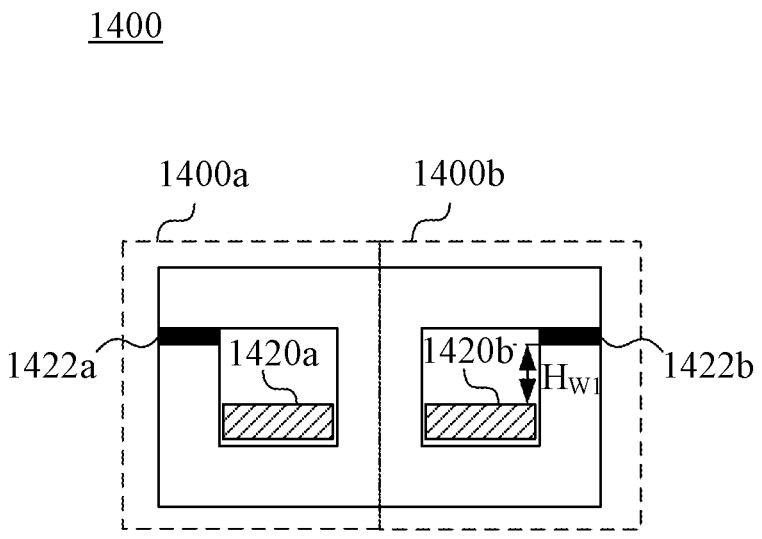
FIG. 14A is a diagram of the integrated magnetic core in an embodiment of the present invention.
Figure 15A:
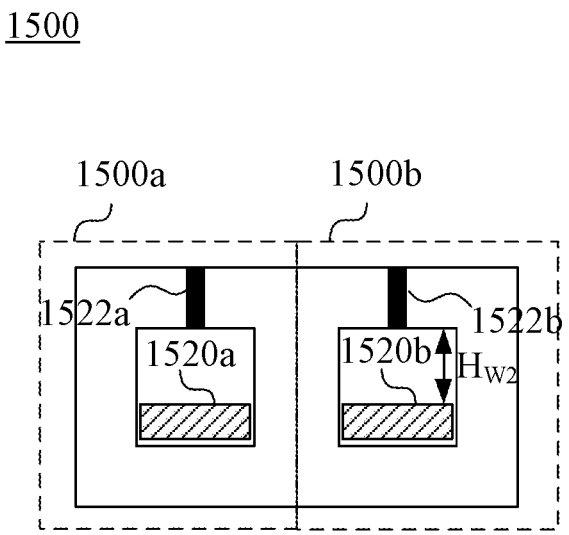
FIG. 15A is a diagram of the integrated magnetic core in an embodiment of the present invention.

FIG. 14A is a diagram of the integrated magnetic core 1400 in an embodiment of the present invention. FIG. 15A is a diagram of the integrated magnetic core 1500 in an embodiment of the present invention.

In the embodiment illustrated in FIG. 14A, the integrated magnetic core 1400 includes two magnetic core units 1400*a*-1400*b* and corresponding windows that further include the corresponding inductor windings 1420*a* and 1420*b*. The magnetic core units 1400*a*-1400*b* include first material sections 1422*a* and 1422*b* respectively. In the embodiment illustrated in FIG. 15A, the integrated magnetic core 1500 includes two magnetic core units 1500*a*-1500*b* and corresponding windows that further include the corresponding inductor windings 1520*a* and 1520*b*. The magnetic core units 1500*a*-1500*b* include a first material sections 1522*a* and 1522*b* respectively.

Figure 14B:
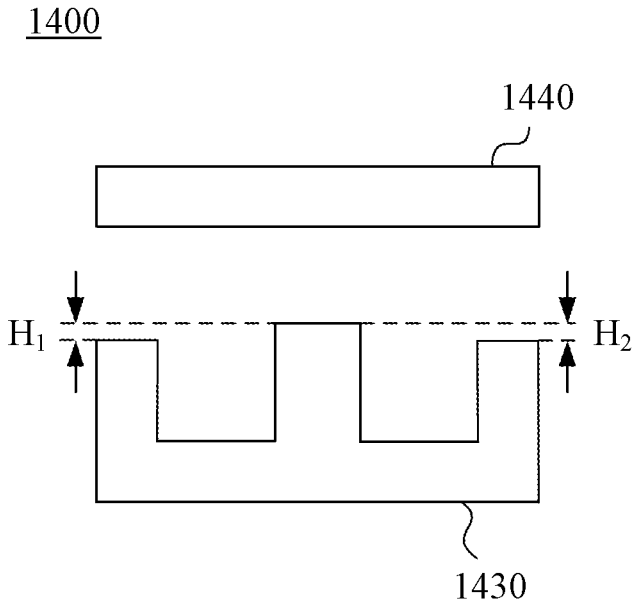
FIG. 14B is a diagram of the manufactured structure of the integrated magnetic core illustrated in FIG. 14A in an embodiment of the present invention.

FIG. 14B is a diagram of the manufactured structure of the integrated magnetic core 1400 illustrated in FIG. 14A in an embodiment of the present invention.

In order to manufacture the integrated magnetic core 1400 in FIG. 14A, the implementation is realized by fabricating the magnetic core base 1430 and the magnetic core top cover 1440 illustrated in FIG. 14B respectively. The vertical distances of the pillars of the two sides of the magnetic core base 1430 relative to the magnetic core top cover 1440 are H1 and H2 respectively. In order to keep the inductance of the two inductors identical to each other, it may be necessary to keep H1=H2. Since the top surfaces of the side pillars and the top surface of the middle pillar are not at the same plane, the polishing of the side pillars has to be performed by two steps, which easily results in the inequality between H1 and H2 due to the tolerances of the manufacturing of the magnetic core. In order to minimize the difference between H1 and H2, the subsequent polishing of the top surfaces of the side pillars is required. It is more difficult to control the accuracy in such a method.

Figure 15B:
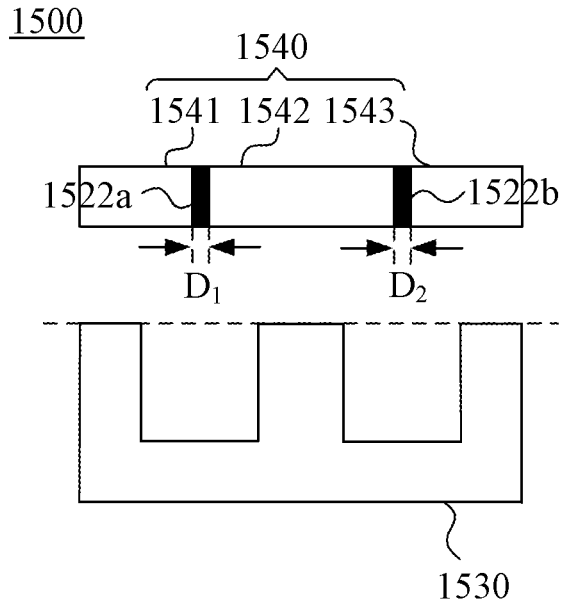
FIG. 15B is a diagram of the manufactured structure of the integrated magnetic core illustrated in FIG. 15A in an embodiment of the present invention.

FIG. 15B is a diagram of the manufactured structure of the integrated magnetic core 1500 illustrated in FIG. 15A in an embodiment of the present invention.

In order to manufacture the integrated magnetic core 1500 in FIG. 15A, the implementation is realized by fabricating the magnetic core base 1530 and the magnetic core top cover 1540 illustrated in FIG. 15B respectively. The heights of the side pillars and the middle pillar of the magnetic core base 1530 are the same. By polishing the three surfaces at the same time, the inequality of the pillars during the fabrication of the magnetic core can be solved to keep the heights thereof same. Further, the magnetic core top cover 1540 is formed by adhering the magnetic cores 1541, 1542 and 1543 with glue. In order to keep the inductance of the two inductors the same, the widths D1 and D2 of the first material sections 1522*a* and 1522*b* of the magnetic core top cover 1540 needs to be controlled to be identical to each other. In another method, spherical particles that are non-conductive and nonmagnetic insulator and have a diameter of D1 are mixed in the binder to fix the distance between the parts to be adhered in the magnetic core. The consistency of the inductance of the inductors is increased.

In order to follow the principle of sharing the magnetic cores, the first section can be disposed at any place of the non-shared magnetic core part. Therefore, different shapes of the magnetic core can be formed when a multiple of magnetic cores are shared. In combination with FIG. 14B, the first material sections 1422*a* and 1422*b* illustrated in FIG. 14A are disposed at the connection part of pillars of the magnetic core base 1430 and the magnetic core top cover 1440 of the integrated magnetic core 1400. In FIG. 15A, the first material sections 1522*a* and 1522*b* are disposed at the magnetic core top cover 1540. Though the two magnetic cores are equivalent from the point of view of the magnetic path, the implementations of the fabrication are different. As a result, the integrated magnetic core 1500 having the first material sections 1522*a* and 1522*b* disposed at the magnetic core top cover 1540 illustrated in FIG. 15A has better control over the accuracy of the inductance and the greater convenience of the manufacturing process than the integrated magnetic core 1400 having the first material sections 1422*a* and 1422*b* formed at the side pillars illustrated in FIG. 14A.

Besides, for the windings of the magnetic cores, the first material sections bring diffusion of the magnetic field that results in the increase of the loss of the inductor windings. The distance to the first material sections is closer, the loss of the inductor windings is larger. Supposed that between FIG. 14A and FIG. 15A, the sizes are identical except that the first material sections of the magnetic core are different. When the vertical distance from the inductor winding 1420*b* to the first material section 1422*b* in FIG. 14A is Hw1, and the vertical distance from the inductor winding 1520*b* to the first material section 1522*b* in FIG. 15A is Hw2, it is obvious that Hw2>Hw1. As a result, the loss of the inductor windings in FIG. 15A is smaller.

The two shared magnetic cores in FIG. 15A can not only be expanded along the direction vertical to the horizontal dimension, but also can add one or more than one magnetic core units along the horizontal dimension. It is easy to perform expansion to three or more than three paths of shared magnetic cores.

Figure 15C:
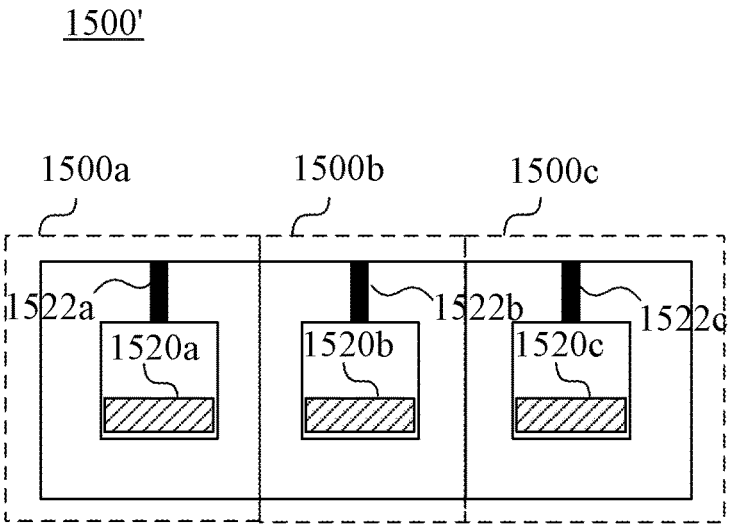
FIG. 15C is a diagram of the integrated magnetic core in an embodiment of the present invention.
Figure 15D:
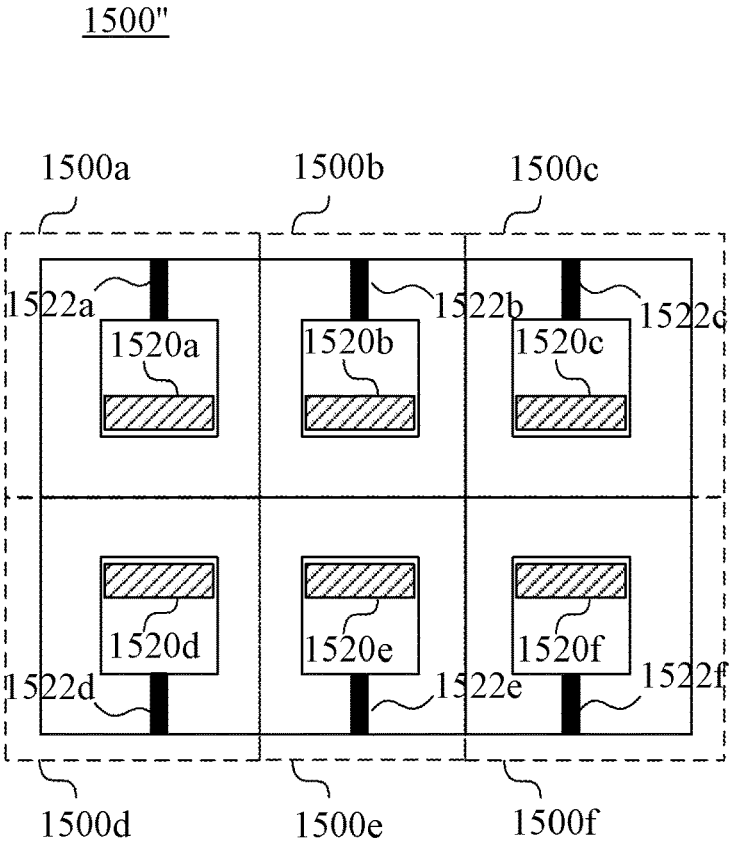
FIG. 15D is a diagram of the integrated magnetic core in an embodiment of the present invention.

FIG. 15C is a diagram of the integrated magnetic core 1500' in an embodiment of the present invention. The integrated magnetic core 1500' is the expansion of the integrated magnetic core 1500 in FIG. 15A and has three paths of shared magnetic cores that includes the magnetic core units 1500*a*-1500*c* and the corresponding windows and includes the corresponding inductor windings 1520*a*-1520*c*. The magnetic core units 1500*a*-1500*c* includes the first material sections 1522*a*-1522*c* respectively. The expansion along the horizontal dimension is very elastic and convenient. No addition adjustment during the fabrication of the whole magnetic core is needed. FIG. 15D is a diagram of the integrated magnetic core 1500" in an embodiment of the present invention. The integrated magnetic core 1500" is the mirror expansion on the basis of the integrated magnetic core 1500' in FIG. 15C along the direction vertical to the horizontal dimension. The integrated magnetic core 1500" has magnetic core units 1520*a*-1520*f* and the corresponding windows and includes the corresponding inductor windings 1520*a*-1520*f*. The magnetic core units 1500*a*-1500*f* includes the first material sections 1522*a*-1522*f* respectively. Every time the number of paths is doubled, only one polishing process is added. The fabrication process is relatively easier.

Figure 15E:
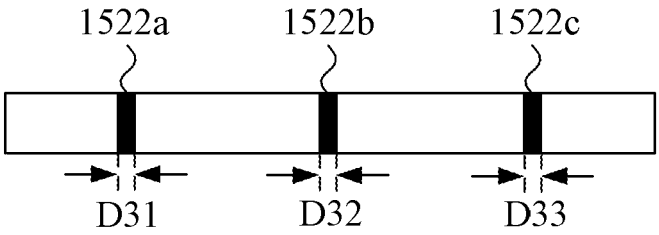
FIG. 15E is a diagram of a top cover in an embodiment of the present invention.

In addition, it needs to point out that when three or more than three paths of shared magnetic cores are expanded along the x dimension (taking the three paths illustrated in FIG. 15C as an example), the top cover is as shown in FIG. 15E. The length of the first material section 1522*a* of the magnetic core unit 1500*a* is D31, the length of the first material section 1522*b* of the magnetic core unit 1500*b* is D32 and the length of the first material section 1522*c* of the magnetic core unit 1500*c* is D33. The common design is to keep D31, D32 and D33 as identical as possible during fabrication. Under an ideal condition that the effect of the tolerance is neglected, it can be known from the symmetry of the structure that the inductances of the magnetic core units 1500*a* and 1500*c* are the same. Since the magnetic core unit 1500*b* is not completely symmetrical to them, the inductance Lb of the magnetic core unit 1500*b* is not identical with the inductance La of the magnetic core unit 1500*a*.

Figure 15F:
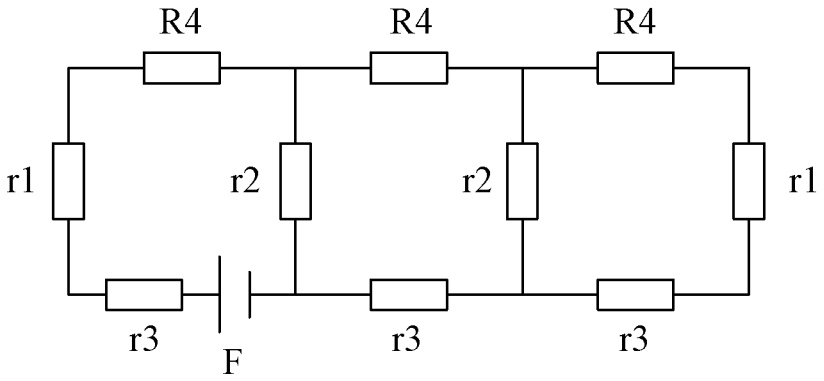
FIG. 15F is a diagram of a magnetic path model of the magnetic core unit in an embodiment of the present invention.
Figure 15G:
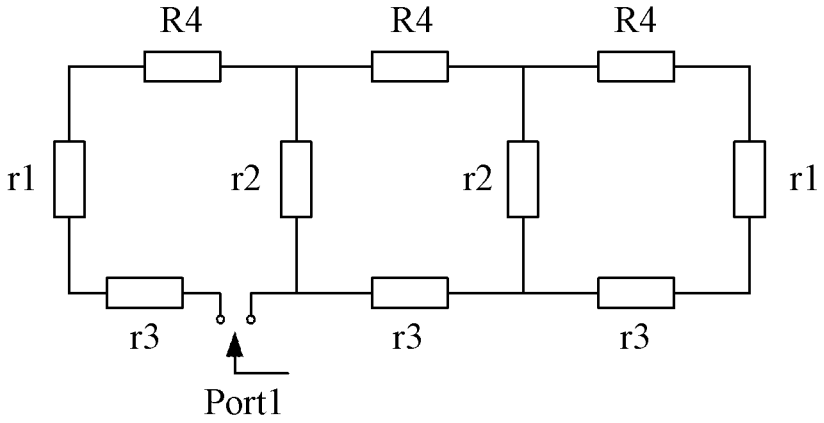
FIG. 15G is a diagram of a magnetic path model of the magnetic core unit in an embodiment of the present invention.
Figure 15H:
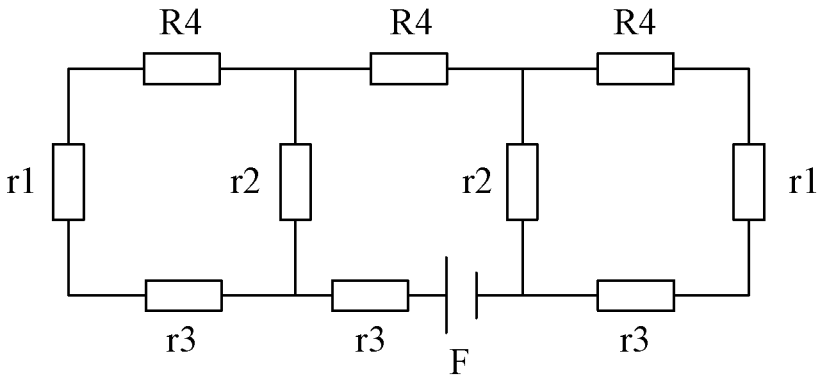
FIG. 15H is a diagram of a magnetic path model of the magnetic core unit in an embodiment of the present invention.
Figure 15I:
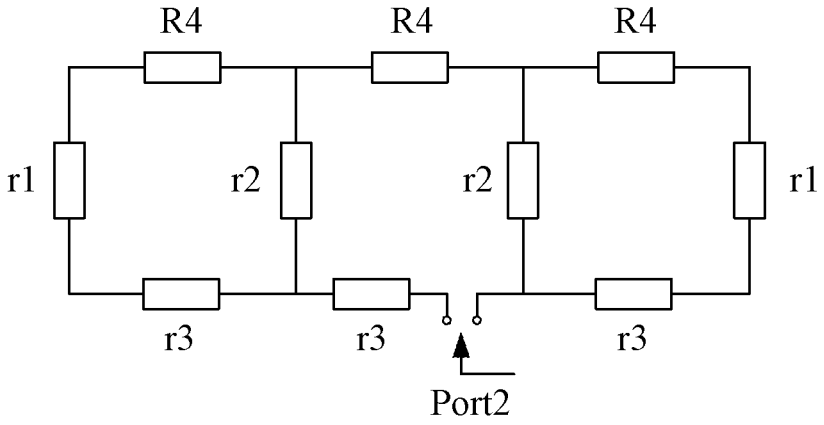
FIG. 15I is a diagram of a magnetic path model of the magnetic core unit in an embodiment of the present invention.

FIG. 15F is a diagram of a magnetic path model of the magnetic core unit 1500*a* in an embodiment of the present invention. The total reluctance Za is the total impedance from Port 1 (as illustrated in FIG. 15G). Similarly, FIG. 15H is a diagram of a magnetic path model of the magnetic core unit 1500*b* in an embodiment of the present invention. The total reluctance Zb is the total impedance from Port 2 (as illustrated in FIG. 15I). According to the relation of the parallel and serial connection of the magnetic path, Za is larger than Zb. The inductance of the magnetic core unit is inversely proportional to the total reluctance of the magnetic path. As a result, La<Lb, and Lb=(1+α)*La. Normally, the range of α is 0.1%~10%. In the actual inductor specification, the inductors having the same size have an inductance bias of 10%. As a result, in common situations, the bias of the inductance La and Lb is acceptable. However, for the multi-path inductors connected in parallel and the inductors having higher requirement of the control of the inductance accuracy, the bias of the inductance needs to be modified. The practical method is to design the length D32 of the first material section 1522*b* of the magnetic core unit 1500*b* to be (1+α) times of the length D31 of the first material section 1522*a* of the magnetic core unit 1500*a*. As a result, in the embodiment of the integrated magnetic core 1500' in FIG. 15C, the reluctance of the first material section 1522*b* of the magnetic core unit 1500*b* that has two neighboring magnetic core units is larger than the reluctance of the first material sections 1522*a* and 1522*c* of the magnetic core units 1500*a* and 1500*c* respectively that each of them has only one neighboring magnetic core unit. So on and so forth, in order to guarantee the balance of the inductance with the magnetic core units having less neighboring magnetic core units and the magnetic core units having more neighboring magnetic core units, the magnetic resistance of the first material sections in the magnetic core units having more neighboring magnetic core units may be designed to be larger than the reluctance of the first material sections in the magnetic core units having less neighboring magnetic core units. For example, a length of air gap (i.e. first material section 1522*b* in FIG. 15C) of magnetic core unit 1500*b* may be made longer than each of the lengths of air gaps (i.e. first material sections 1522*a* and 1522*c*) of magnetic core unit 1500*a* and 1500*c*, but the invention is not limited to this regard.

Surely, in other embodiments, the condition that the reluctance of the first material sections in one of the magnetic core units is larger than the reluctance of the first material sections in another one of the magnetic core units can be realized when the permeability of the material of the first material sections in one of the magnetic core units is smaller than the permeability of the material of the first material sections in another one of the magnetic core units.

The advantage of the present invention is to shrink the size of the multiple of integrated inductors by using the design of the integrated magnetic core.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An integrated magnetic core, integrated with a plurality of inductor windings to form a plurality of inductors comprising:

at least two windows, each having at least one of the inductor windings disposed therein; and a plurality of magnetic core units, each having a closed geometrical structure to form one of the at least two windows, wherein two of the neighboring magnetic core units have a shared magnetic core part, wherein the closed geometrical structure is a quadrangle formed by the shared magnetic core part, two non-shared magnetic core parts for respectively connecting two ends of the shared magnetic core part, and a connecting magnetic core part for connecting the two non-shared magnetic core parts;

wherein each of the magnetic core units comprise a first material section, and a magnetic permeability of the first material section is less than that of the shared magnetic core part, wherein the permeability of the first material section is smaller than or equal to 50, and wherein the first material section is only disposed at one of the two non-shared magnetic core parts to make the reluctance of the shared magnetic core part be smaller than the reluctance of the non-shared magnetic core part of the magnetic core units, and each of the inductor windings is disposed respectively at another one of the two non-shared magnetic core parts to form a distance between the inductor winding and the first material section.

2. The integrated magnetic core of claim 1, wherein the number of the first material section is larger than one.

3. The integrated magnetic core of claim 2, wherein the first material section is disposed discretely or intensively at the two non-shared magnetic core part of the magnetic core units.

4. The integrated magnetic core of claim 1, wherein the shared magnetic core part comprises a second material section, wherein the reluctance of the second material section is smaller than or equal to the reluctance of the first material section.

5. The integrated magnetic core of claim 1, wherein the magnetic core units comprise a magnetic core top cover and a magnetic core base, wherein the magnetic core top cover is disposed above the magnetic core base to form the closed geometrical structure.

6. The integrated magnetic core of claim 5, wherein the first material section is disposed at the magnetic core top cover.

7. An integrated inductor apparatus to integrate a plurality of inductors, wherein the integrated inductor apparatus comprises:

a plurality of inductor windings; and an integrated magnetic core integrated with the inductor windings to form the inductors, wherein the integrated magnetic core comprises:

at least two windows each having at least one of the inductor windings disposed therein; and a plurality of magnetic core units each having a closed geometrical structure to form one of the at least two windows, wherein two of the neighboring magnetic core units have a shared magnetic core part, wherein the closed geometrical structure is a quadrangle formed by the shared magnetic core part, two non-shared magnetic core parts for respectively connecting two ends of the shared magnetic core part, and a connecting magnetic core part for connecting the two non-shared magnetic core parts;

wherein the magnetic core units comprise a first material section, and a magnetic permeability of the first material section is less than that of the shared magnetic core part, wherein the permeability of the first material section is smaller than or equal to 50, and wherein the first material section is only disposed at one of the two non-shared magnetic core parts, and each of the inductor windings is disposed respectively at another one of the two non-shared magnetic core parts to form a distance between the inductor winding and the first material section.

8. The integrated inductor apparatus of claim 7, wherein the shared magnetic core part comprises a second material section, wherein the reluctance of the second material section is smaller than or equal to the reluctance of the first material section.

9. The integrated inductor apparatus of claim 7, wherein the magnetic core units comprise a magnetic core top cover and a magnetic core base, wherein the magnetic core top cover is disposed above the magnetic core base to form the closed geometrical structure.

10. The integrated inductor apparatus of claim 9, wherein the first material section is disposed at the magnetic core top cover.

11. The integrated inductor apparatus of claim 9, wherein the reluctance of the first material section of one of the magnetic core units is larger than reluctance of the first material section of another one of the magnetic core units.

12. The integrated inductor apparatus of claim 7, wherein the reluctance of the first material section of the magnetic core units having two of the neighboring magnetic core units is larger than the reluctance of the first material section of the magnetic core units having only one of the neighboring magnetic core units.

13. The integrated inductor apparatus of claim 7, wherein the inductors are disposed in a switching mode power supply and are connected to a multi-path common input terminal or a multi-path common output terminal of the switching mode power supply.

14. The integrated inductor apparatus of claim 7, wherein current directions of the inductor windings are same and have a predetermined phase difference.

* * * * *